United States Patent [19]

Seddon

[11] Patent Number: 4,846,599

[45] Date of Patent: Jul. 11, 1989

[54] LIQUID DELIVERY ACCESSORY

[76] Inventor: John G. Seddon, 34 Ross Smith Avenue, Beaumaris, 3193, Victoria, Australia

[21] Appl. No.: 31,688

[22] Filed: Mar. 26, 1987

[30] Foreign Application Priority Data

Mar. 26, 1986 [AU] Australia ..... 05217/86

[51] Int. Cl.[4] ..... A47L 25/00; A46B 11/02

[52] U.S. Cl. ..... 401/202; 401/207; 401/262; 401/264; 15/210 R; 222/153; 215/209

[58] Field of Search ..... 401/202, 205, 206, 207, 401/269, 137, 289, 262–266; 215/209; 15/210 R, 160; 222/83, 153, 91, 568, 575; D4/114, 138; D6/551

[56] References Cited

U.S. PATENT DOCUMENTS

| | | | |
|---|---|---|---|
| 570,573 | 11/1896 | Tower | 401/269 |
| 1,154,369 | 9/1915 | Browning | 15/160 |
| 2,765,484 | 9/1956 | Zagel | 15/210 R |
| 2,814,817 | 12/1957 | Ducker | 401/206 |
| 2,919,455 | 1/1960 | Turner | 15/210 R X |
| 2,976,560 | 3/1961 | Turner | 401/205 X |
| 3,101,856 | 8/1963 | Whiteman, Jr. | 215/209 |
| 3,147,512 | 9/1964 | Gleason | 401/202 |
| 3,343,200 | 9/1967 | Düring | 401/206 X |
| 3,922,099 | 11/1975 | Christine et al. | 222/91 X |
| 3,938,707 | 2/1976 | Schmit | 222/91 X |
| 4,303,348 | 12/1981 | O'Brien | 401/289 X |
| 4,583,668 | 4/1986 | Maynard, Jr. | 222/568 X |

FOREIGN PATENT DOCUMENTS

| | | |
|---|---|---|
| 2040496 | 8/1971 | Fed. Rep. of Germany . |
| 2831205 | 1/1980 | Fed. Rep. of Germany . |
| 429069 | 1/1967 | Switzerland . |
| 1033582 | 6/1966 | United Kingdom . |

*Primary Examiner*—Richard J. Apley
*Assistant Examiner*—David J. Bender
*Attorney, Agent, or Firm*—Knobbe, Martens, Olson & Bear

[57] ABSTRACT

A liquid delivery accessory includes an elongate generally U-shaped body and a liquid delivery passage in the body. Provision is made to couple the body to a container of liquid whereby liquid may flow downwardly from the container into the passage in one of the arms of the U-shaped body. The other arm has an outlet aperture from the passage. When the body is coupled to the container to receive downwardly flowing liquid therefrom and the container is disposed with its axis vertical, the arms of the U-shaped body extend at an inclination to the container axis, and the said other arm is below the one arm and is directed upwardly towards its free end.

17 Claims, 7 Drawing Sheets

LIQUID DELIVERY ACCESSORY

This invention relates to a liquid delivery accessory which has particular utility in facilitating the cleaning of toilet bowls.

U.S. Pat. No. 4,437,585 to Duering discloses a squeeze bottle with an integral nozzle outlet positioned to facilitate the jetting of liquid in the bottle onto different surfaces within a toilet bowl. This arrangement makes no provision, however, for scouring or scrubbing those surfaces and is therefore of quite limited effect. An earlier patent to Duering, British Pat. No. 1,033,582 depicts a flat cleaning foot covered with foamed rubber and supplied with cleaning solvent from a container via flexible tubing. The foot has a reversely and outwardly directed heel portion which is enveloped by the foamed rubber and may thereby be employed to scour under the flushing rim of a toilet bowl. However, this device is not suitably dimensioned for cleaning the bottom of the bowl and the adjacent S-bend.

German patent application No. 2,040,496 by Dietsche shows a liquid delivery accessory adapted to fit onto a squeeze bottle. The accessory has a flow control valve, an upstanding stem with bristles at the head, and a laterally projecting brush segment for cleaning under the flushing rim. Attention is also drawn to a similar design in German patent application No. 2,831,205. Again, these accessories are of limited utility in effectively cleaning the various surfaces of the bowl.

It is an objective of the invention to provide a liquid delivery accessory of enhanced versatility in the cleaning of toilet bowls.

The invention provides a liquid delivery accessory comprising:

an elongate generally U-shaped body;

a liquid delivery passage in said body;

means for coupling the body to a container of liquid whereby liquid may flow downwardly from the container into said passage in one of said arms of the U-shaped body; and an outlet aperture from said passage in the other of said arms of the U-shaped body;

said body being such that when it is coupled to said container to receive downwardly flowing liquid therefrom and the container is disposed with its axis vertical, said arms of the U-shaped body extend at an inclination to said axis, and said other arm is below said first arm and is directed upwardly towards its free end.

The accessory preferably further includes a liquid absorbent cleaning pad mounted to said body so as to extend about the outside faces of said other arm and of the bridging portion of the U-shaped body, and to receive liquid from said outlet aperture.

The body is advantageously an integrally moulded component and includes a hollow funnel portion divergent from the free end of said one arm to guide liquid to said passage.

The bridging portion of the body preferably defines a substantially flat outside face.

Said one arm of the U-shaped body is conveniently substantially rigid but said other arm is capable of flexing with respect to said one arm.

Said outlet aperture is preferably defined by a hollow valve tip for other arm, of resiliently deformable material, which tip includes an outlet slit that remains substantially closed when the accessory is not in use but is opened by pressing the tip against a surface to be cleaned and thereby deforming the tip to open the slit.

Said coupling means preferably includes a tubular spigot for piercing a closure wall of the container and thereby opening communication between the interior of the container and the passage in said body The coupling means advantageously further comprises a coupling ring which is detachably engageable with an open mouth of said body and includes said spigot and a skirt portion about said spigot which is detachably engageable with the neck of a bottle container. Said closure wall of the container is preferably a transverse membrane across the neck of the container.

The liquid absorbent cleaning pad may be retained on the body by co-operative engagement between a lug on the body and an aperture on the pad.

The accessory may further include a detachable cover for the cleaning pad and said other arm of the body. Such cover may include a tapered receptacle and a hingeable retention cap and advantageously includes aeration openings for ventilation and drying of the pad when the accessory is not in use.

The invention also provides a liquid delivery accessory comprising:

an elongate generally U-shaped body;

a liquid delivery passage in said body;

means for coupling the body to a container of liquid whereby liquid may flow downwardly from the container into said passage in one of said arms of the U-shaped body; and an outlet aperture from said passage in the other of said arms of the U-shaped body;

wherein said outlet aperture is defined by a hollow valve tip for said other arm, of resiliently deformably material, which tip includes an outlet slit that remains substantially closed when the accessory is not in use but is opened by pressing the tip against a surface to be cleaned and thereby deforming the tip to open the slit.

The invention will be further described, by way of example only, with reference to the accompanying drawings, in which.

Figure 1:
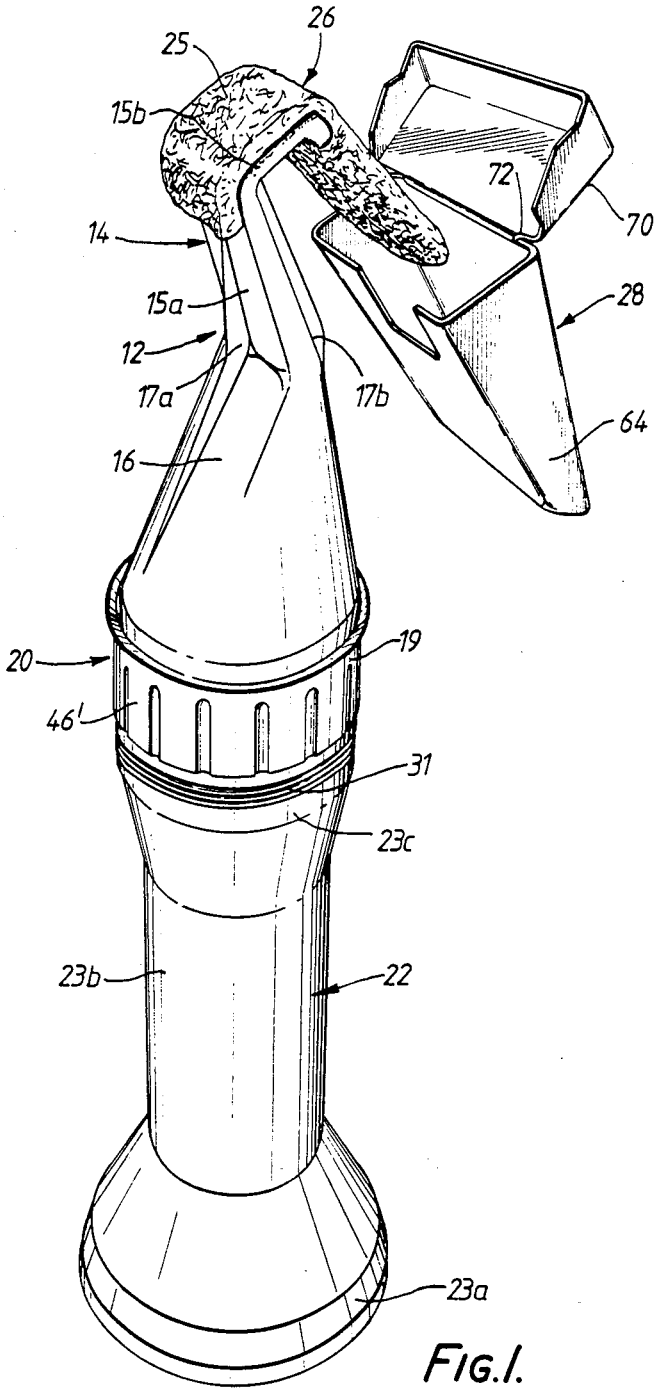
FIG. 1 is a perspective view of a liquid delivery accessory designed and dimensioned for use in the cleaning of toilet bowls and shown attached to a bottle containing liquid cleaner and/or disinfectant.
Figure 2:
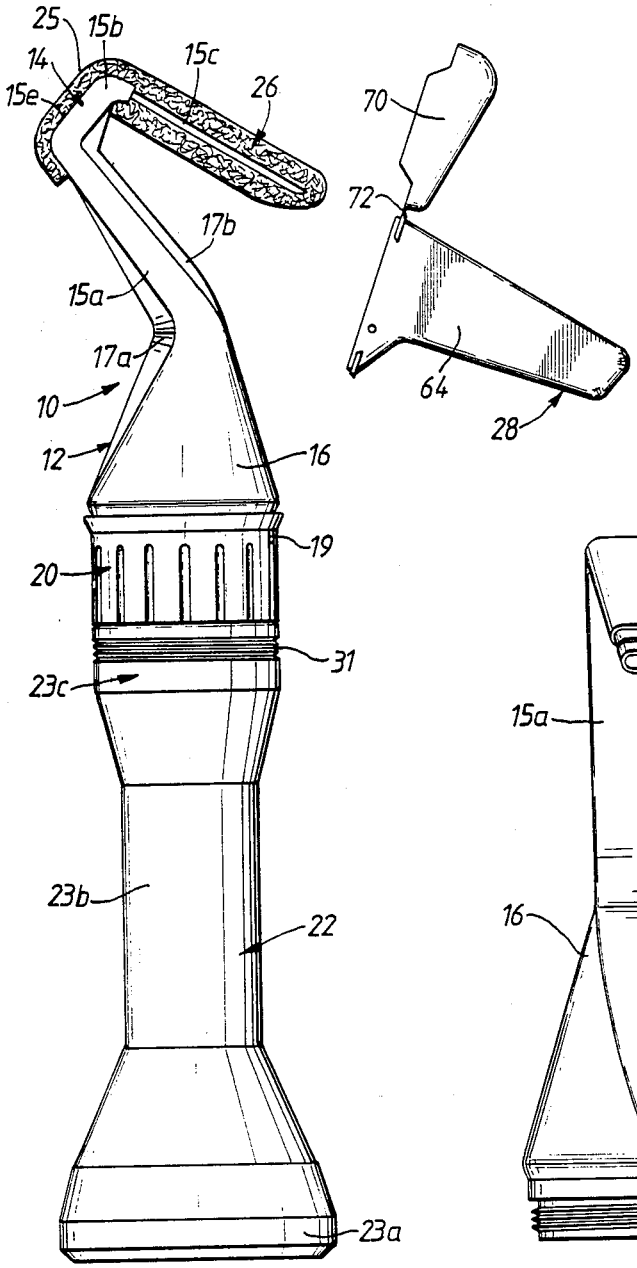
FIGS. 2 and 3 are respectively a side elevational view and an upright axial cross-section of the assembly of accessory and bottle shown in FIG. 1.
Figure 3:
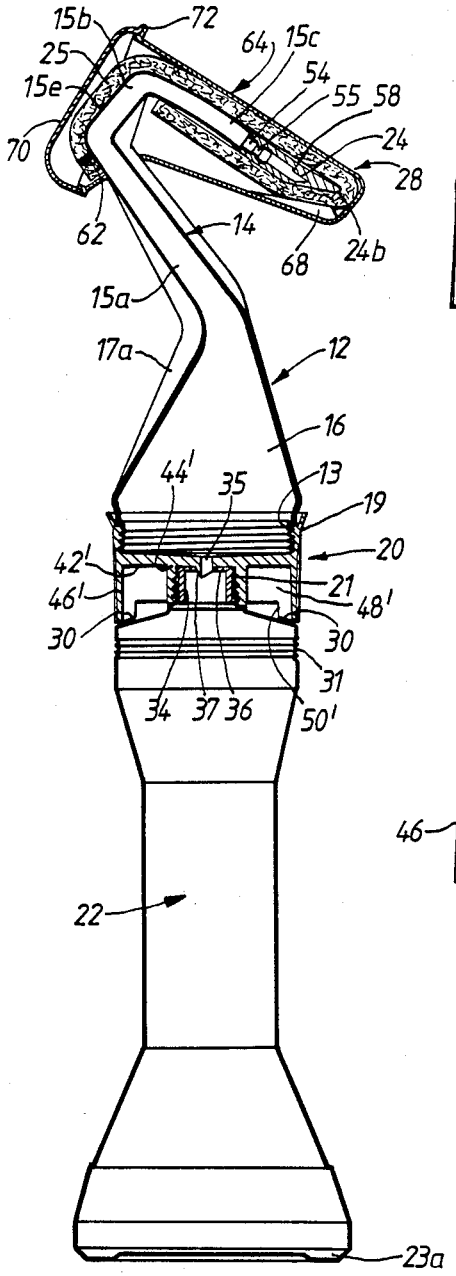
Figure 5:
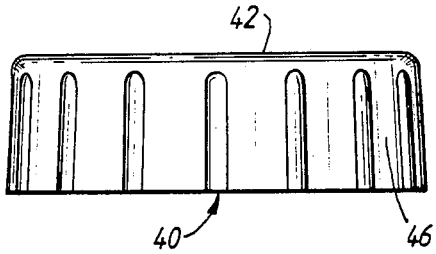
FIG. 5 is a side elevation of a closure cap for the bottle.
Figure 6:
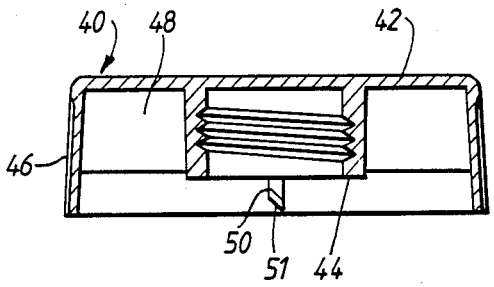
FIGS. 6 and 7 are respectively an axial cross-section and an underneath view of the bottle closure cap.
Figure 7:
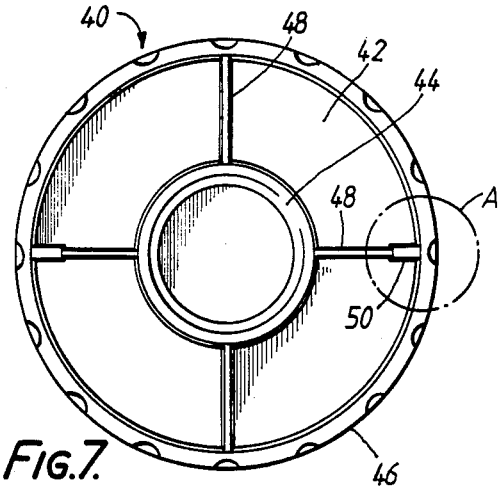
Figure 7A:
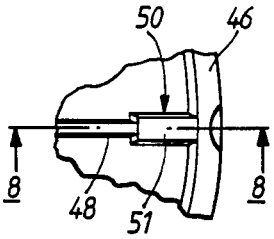
FIG. 7A is an enlargement of the portion "A" of FIG. 7.
Figure 8:
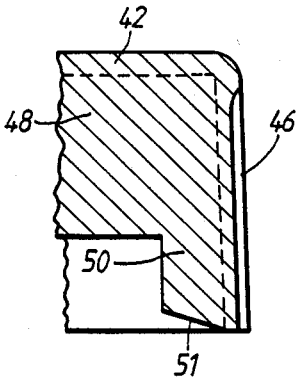
FIG. 8 is a cross-section on the line 8—8 in FIG. 7A.

The illustrated accessory 10 includes an integral blow-moulded neck 12 having a delivery tube 14 formed as a generally U-shaped body and an intake funnel 16 for the tube, an interchangeable coupling ring 20 for coupling neck 12 to a bottle 22, a valve tip 24 for tube 14, a liquid absorbent cleaning pad 26, and a protective cover 28. Accessory 10 is shown in FIGS. 1 to 3 mounted to a bottle 22 in the storage condition. It will be appreciated from what follows that the assembly is inverted for use in cleaning a toilet (as shown in FIGS. 14A–14D) but subsequent description will assume for convenience that the assembly is in the storage condition.

Figure 4:
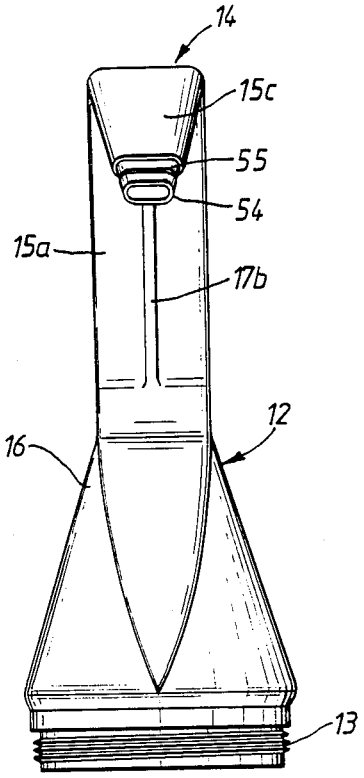
FIG. 4 is a front elevation of the neck of the accessory.
Figure 10:
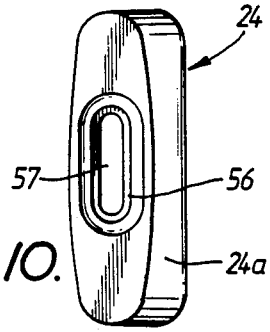
FIG. 10 is an end view of the valve tip.

U-shaped tube 14 of neck 12 is of rectangular cross-section (FIG. 4) and includes a first elongate arm or portion 15*a* extending upwardly outwardly from the apex of funnel 16, a short transverse bridging portion 15*b* with a substantial flat outside face 15*e*, and a second elongate arm or terminal portion 15*c* which in the storage condition is directed laterally downwardly with respect to the upright axis of the bottle and is transversely tapered towards its free end (FIGS. 4 and 10). It will be seen that when bottle 22 is inverted and its axis is vertical, tube portions 15*a*, 15*c* extend at an inclination to the axis of the bottle and that tube portion 15*c* is below portion 15*a* and has its free end directed upwardly. The angle of inclination of portion 15*a* is preferably between 25° and 60°, say about 35° to 40°, to the bottle axis.

Tube portion 15*a* is slightly convergent away from the funnel and it, as well as funnel 16 and transverse tube portion 15*b*, are relatively thick walled and strengthened by ribs 17*a*, 17*b* so as to achieve a substantially rigid structure. Terminal tube portion 15*c*, on the other hand, is thinner walled and unribbed so as to be readily capable of some flexure with respect to the rest of the neck and to thereby accommodate structural variations in toilet bowls.

Bottle 22 is integrally blow-moulded in a resiliently deformable material to provide a frustoconical base 23*a* for stability, a reduced hand grip intermediate portion 23*b*, and a broader top 23*c* with a reduced diameter externally threaded neck 21. The tapered land about the neck carries diametrically opposed external lugs 30 near its rim for a purpose hereinafter to be described.

A closure cap 40 for bottle 22, not shown in FIGS. 1 to 3, is detailed in FIGS. 5 to 8. As will be seen, it includes many of the features of coupling neck 20 and indeed the two parts are quite complementary. Cap 40 is a one-piece moulding and includes a flat circular top 42 bridging an inner skirt 44 and an outer skirt 46. Skirt 44 is internally threaded for detachably engaging the neck 21 of bottle 22 and both skirts are braced by four equiangularly spaced radial webs 48 which extend between the skirts. Two of the diametrically opposed webs 48 have an outer depending extension 50 with a radially inwardly upwardly inclined bottom edge 51. When the cap is tightened onto the bottle neck, web extensions 50 normally act as abutments striking lugs 30 on bottle 22 to prevent simple rotation of the cap on the bottle. The cap can only be removed if the upper side of the bottle, defined by shallow ribbing 31, is squeezed inwardly to depress lugs 30 below edges 51 and out of engagement with the web extensions 50. This arrangement provides a child-proof safety feature.

Figure 13:
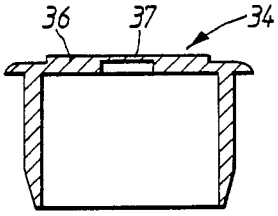
FIG. 13 is an axial cross-section of the sealing plug for the bottle.
Figure 14:
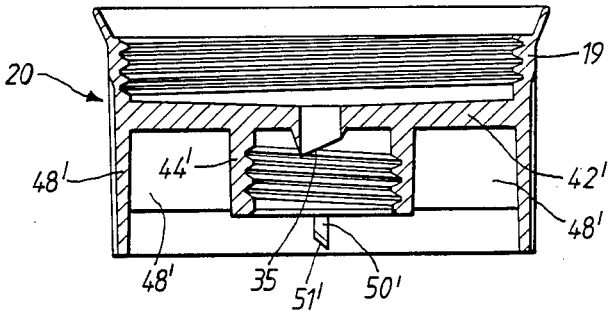
FIG. 14 is an axial cross-section of the coupling ring of the accessory.

Neck 21 of bottle 22 is sealingly closed by a sealing plug 34 (FIGS. 3 and 13) which can be friction fitted or otherwise sealed into place after the bottle is filled. Plug 34 includes a transverse membrane 36 with a central reduced-thickness portion 37.

Coupling ring 20 (FIG. 14) is similar to cap 40 (and thus its parts are indicated by like primed reference numerals) save for two significant differences. The ring includes a similar child-proof safety feature but additionally has an upstanding internally threaded skirt 19 which detachably engages an externally threaded inwardly upset annular mouth 13 of funnel 16. Ring 20 also carries at its centre a depending tubular spigot 35 provided with an obliquely truncated bottom edge so as to define a tip for piercing and sealingly projecting through portion 37 of sealing membrane 36. Plug 34 is designed so that any attempt to refill and thereby re-use bottle 22, an unsafe and unhygienic practice, will cause slitting or widening of membrane 36 and thus leaking of the bottle at the membrane when it is inverted on reassembly with accessory 10.

Figure 9:
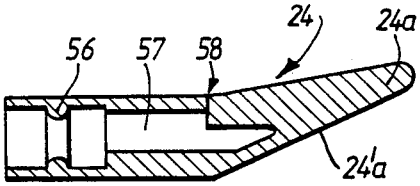
FIG. 9 is an enlarged cross-section of the valve tip forming part of the accessory depicted in FIGS. 1 to 3.

Valve tip 24 (FIGS. 3, 9 and 10) is a hollow cap of thermoplastic elastomeric rubber for the terminal portion 15*c* of tube 14. Tube portion 15*c* ends in a reduced diameter nozzle 54 having an annular groove 55. Valve tip 24 has an inner annular rib 56 which engages groove 55 and retains the valve in place when it is press-fitted onto nozzle 54. A transverse slit 58 in valve tip 24 provides for liquid flow communication between the interior cavity 57 of the valve and the exterior. The slit is at the inner margin of an upwardly kinked end portion 24*a* of the valve. This end portion 24*a* flattens out when it is pressed against a surface to be cleaned, whereby the valve body is deformed and the slit 58 opened, but immediately reverts to its base shape and closes the slit on release of pressure.

Figure 11:
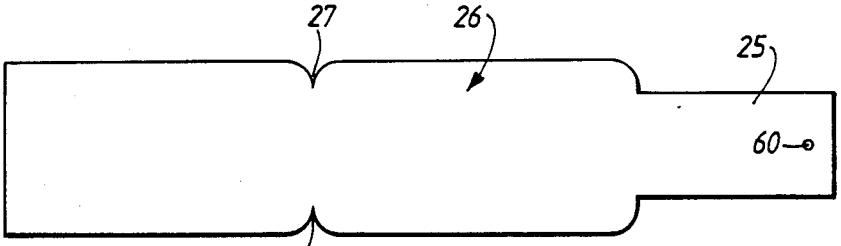
FIG. 11 is a plan view of the cleaning pad laid out flat.

Liquid flowing from slit 58 first flows into and fills at least part of pad 26. Pad 26 is formed in a mildly abrasive liquid absorbent material which will not scratch the interior surface of a toilet bowl. It is shown in flat form in FIG. 11. In situ, the pad is folded about and substantially embraces both valve 24 and the terminal portion 15*c* of tube 14: to facilitate this bending the pad is provided with opposed side notches 27. A tail portion 25 of the pad is arranged to extend about transverse tube portion 15*b* over face 15*e* and the pad is held in place by engagement between an aperture 60 in the pad tail and an outstanding lug 62 on tube 14.

Figure 12:
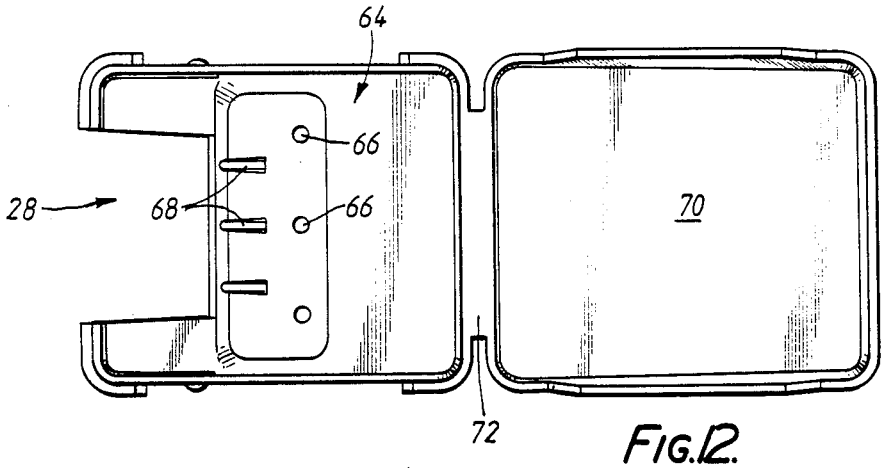
FIG. 12 is an end view into the open protective cap for the accessory.

Protective cover 28 for the accessory comprises a tapered open-topped receptacle 64 (FIGS. 1 to 3 and 12) which receives the pad 26 and the underlying terminal tube portion and valve. This receptacle has plural aeration apertures 66 (FIG. 12) in its base for ventilating and thereby drying pad 26 when the accessory is not in use. Receptacle 64 also carries three integral internal gussets 68 which engage the pad and compress it against the opposed oblique end surface 24*b* of valve 24, so preventing opening of slit 58.

Cover 28 further includes a cap 70 secured to receptacle 64 by a web hinge 72. This cap closes over the tail portion of the pad, as best seen in FIG. 3.

In use, cover 28 is removed, the illustrated assembly is inverted and lowered into a toilet bowl and the bottle squeezed hard to direct liquid under pressure from the bottle through spigot 35, funnel 16 and tube 14 to valve 24. The valve is opened by a pressure contact with a surface and the cleaning pad impregnated by the expelled liquid. The flow rate can be increased by squeezing the bottle. The device is now ready for scrubbing the various internal surfaces of the bowl and simultaneously applying cleaner and/or disinfectant, as shown in FIGS. 15A to 15D. Separate bottles of detergent and disinfectant may be successively attached to coupling ring 20. The device simultaneously scours a surface to which it is applying liquid.

Figure 15A:
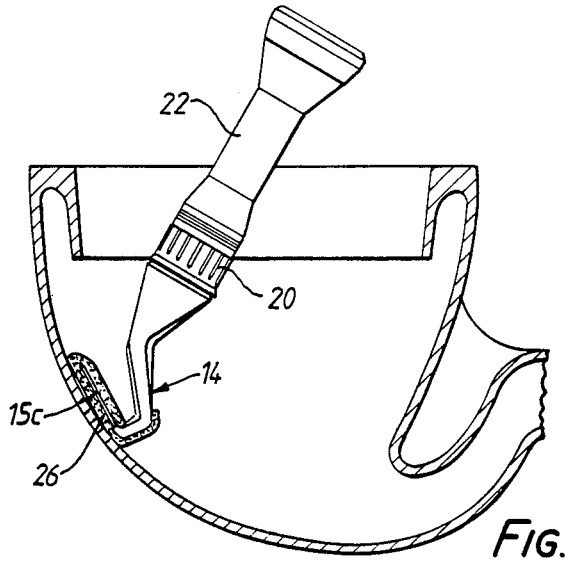
FIGS. 15A to 15D are several somewhat diagrammatic sectional views of a toilet bowl showing the accessory of FIG. 1 in position to clean different surfaces of the bowl.
Figure 15B:
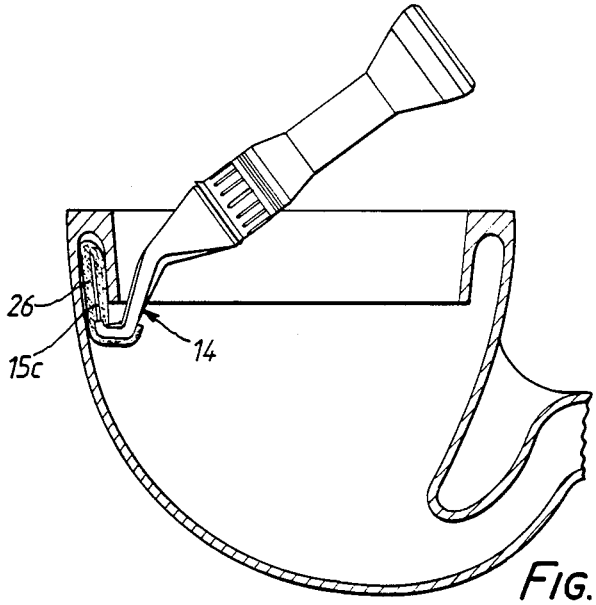
Figure 15C:
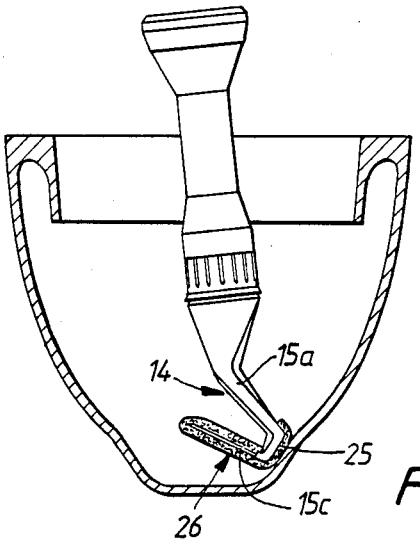
Figure 15D:
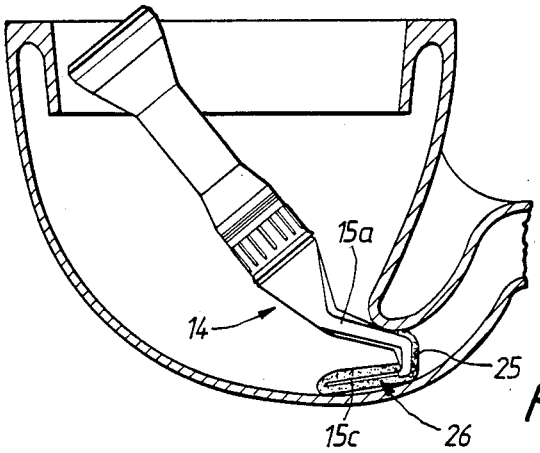

The elongate flat form of terminal portion 15*c* and its inclination to the axis of the bottle, make it ideal for scrubbing the main side surfaces of a toilet bowl (FIG. 15A). The terminal portion 15*c* of the tube with the attached pad is designed to be brought up behind the flush rim of the toilet (FIG. 15B) so that the pad may scour away human excrement, scale and other stains as well as applying a good film of disinfectant to attack pathogens which readily develop in this area. The smaller tail portion 25 of the pad is employed to clean the sides of the bottom of the bowl (FIG. 15C), an operation facilitated by the provision of flat face 15*e* and by the sideways displacement of this face brought about by the inclination of tube arm 15*a*. The inclined U-shape of the neck permits especially effective cleaning of the hidden area between the bowl bottom and the outlet trap or S-bend (FIG. 15D). In all these operations, the hand holding the bottle, which is thereby serving as a handle for the accessory, can be kept well clear of bowl surfaces and indeed need not descend much below the level of the flushing rim.

I claim:

1. A liquid delivery accessory, comprising:

a first body portion formed in a generally U-shaped configuration with a first arm and a second arm forming the sides of the U-shaped body portion, each arm having first and second ends, said U-shaped body portion having a bridging portion connecting the first ends of said arm;

a second body portion having first and second opposing ends, means for coupling said first end of said second body portion to a container of liquid, said coupling means defining an axis parallel to the longitudinal axis of the container when it is attached to the first end of said second body portion;

said first arm of said U-shaped body portion connected to the second end of said second body portion with said U-shaped body portion tilted at an angle with respect to said axis; and a liquid delivery passage extending through said second body portion and said U-shaped body portion from said coupling means to the second arm of said U-shaped body portion, wherein said angle formed by the segment of said axis defined by said coupling means proximate said first arm and said second arm is between 25° and 60°.

2. A liquid delivery accessory according to claim 1 further including a liquid absorbent cleaning pad mounted to said first body portion to receive liquid from said liquid delivery passage.

3. A liquid delivery accessory according to claim 2 wherein said first body portion further comprises a lug and said pad further comprises an aperture, wherein said pad is retained on said first body portion by cooperative engagement between said lug and said aperture.

4. A liquid delivery accessory according to claim 2 further comprising a detachable cover for the cleaning pad and said second arm.

5. A liquid delivery accessory according to claim 4 wherein said cover includes a tapered receptacle and a hingeable retention cap.

6. A liquid delivery accessory according to claim 4 wherein said cover includes aeration openings for ventilation and drying of the pad when the accessory is not in use.

7. A liquid delivery accessory according to claim 1 wherein said first body portion is an integrally moulded component.

8. A liquid delivery accessory according to claim 1 wherein said bridging portion defines a substantial flat outside face.

9. A liquid delivery accessory according to claim 8 further including a liquid absorbent cleaning pad mounted to said first body portion so as to extend about the outside face to receive liquid from said liquid delivery passage.

10. A liquid delivery accessory according to claim 8 wherein said first arm is substantially rigid but said second arm is capable of flexing with respect to said first arm.

11. A liquid delivery accessory according to claim 1 dimensioned so that said second arm may access behind the flushing ring of a toilet bowl.

12. A liquid delivery accessory according to claim 1 wherein said second body portion includes a tubular spigot for piercing a closure wall of a container of liquid for opening communication between the interior of the container and said passage in said first body portion.

13. A liquid delivery accessory according to claim 12 wherein said second body portion further comprises a coupling ring which is detachably engageable with said first body portion and includes a spigot and a skirt portion about said spigot which is detachably engageable with the neck of a bottle container.

14. A liquid delivery accessory according to claim 1 further comprising a container for liquid, wherein said container for liquid is directly coupled to said second body portion.

15. An assembly according to claim 14 wherein said container is a bottle formed of resiliently deformable material.

16. A liquid delivery accessory, comprising:

a first body portion formed in a generally U-shaped configuration with a first arm and a second arm forming the sides of the U-shaped body portion, each arm having first and second ends, said U-shaped body portion having bridging portion connecting the first ends of said arms;

a second body portion having first and second opposing ends, means for coupling said first end of said second body portion to a container of liquid, said coupling means defining an axis parallel to the longitudinal axis of the container when it is attached to the first end of said second body portion;

said first arm of said U-shaped body portion connected to the second end of said second body portion with said U-shaped body portion tilted at an angle with respect to said axis; and a liquid delivery passage formed in a generally U-shaped configuration extending through said second body portion and said U-shaped body portion from said coupling means to the second arm of said U-shaped body portion.

17. A liquid delivery accessory, comprising;

a first body portion formed in a generally U-shaped configuration with a first arm and a second arm forming the sides of the U-shaped body portion, each arm having first and second ends, said U-shaped body portion having a bridging portion connecting the first ends of said arm;

a second body portion having first and second opposing ends, means for coupling said first end of said second body portion to a container of liquid, said coupling means defining an axis parallel to the longitudinal axis of the container when it is attached to the first end of said second body portion;

said first arm of said U-shaped body portion connected to the second end of said second body portion with said U-shaped body portion tilted at an angle with respect to said axis;

a liquid delivery passage extending through said second body portion and said U-shaped body portion from said coupling means to the second arm of said U-shaped body portion; and an outlet aperture defined by a hollow valve tip for said second arm, of resiliently deformable material, which tip includes an outlet slit that remains substantially closed when the accessory is not in use but is opened by pressing the tip against a surface to be cleaned and thereby deforming the tip to open the slit.

* * * * *